United States Patent [19]

Pagnozzi

[11] 4,058,906

[45] Nov. 22, 1977

[54] PROCESS FOR DRYING LARGE PIECES OF WOOD AT SUBATMOSPHERIC PRESSURE OR IN VACUO, PARTICULARLY FOR DRYING DELICATE WOOD AND/OR WOOD WHICH IS EASILY SPLIT

[75] Inventor: Vincenzo Pagnozzi, Rocchetta di Cairo (Savona), Italy

[73] Assignee: Ernesto Guglielmo Pagnozzi, Cairo Montenotte (Savona), Italy

[21] Appl. No.: 687,495

[22] Filed: May 18, 1976

[30] Foreign Application Priority Data

May 19, 1975 Italy ..... 68291/75

[51] Int. Cl.[2] ..... F26B 5/04

[52] U.S. Cl. ..... 34/16.5; 34/92

[58] Field of Search ..... 34/13.4, 13.8, 15, 16.5, 34/92

[56] References Cited

U.S. PATENT DOCUMENTS

| | | | |
|---|---|---|---|
| 688,711 | 12/1901 | Amthor | 34/15 |
| 1,050,151 | 1/1913 | Loomis | 34/13.4 |
| 1,421,685 | 7/1922 | Glessner | 34/92 |
| 1,458,403 | 6/1923 | Glessner | 34/92 |
| 2,064,965 | 12/1936 | Will | 34/13.8 |
| 2,387,595 | 10/1945 | Luth et al. | 34/16.5 X |

*Primary Examiner*—John J. Camby

*Attorney, Agent, or Firm*—Sughrue, Rothwell, Mion, Zinn and Macpeak

[57] ABSTRACT

A process for drying wood at subatmospheric pressures comprising a phase in which the wood is heated up in a sealed environment, is characterized in the fact that this heating-up phase comprises the operations of:

I. introducing into said closed environment an operative fluid which is capable of imparting, moisture to the wood, causing this fluid to cycle repeatedly around a closed circuit in such a way that in every cycle, the fluid passes through a pile formed by the pieces of wood, and then returns without passing through the pile;

II. supplying thermal energy to the operative fluid in such a way that the thermal content of the fluid increases overall in each cycle at a diminishing rate until the fluid reaches a substantially steady cyclical state in which there is no overall increase in its thermal content in each subsequent cycle.

11 Claims, 3 Drawing Figures

PROCESS FOR DRYING LARGE PIECES OF WOOD AT SUBATMOSPHERIC PRESSURE OR IN VACUO, PARTICULARLY FOR DRYING DELICATE WOOD AND/OR WOOD WHICH IS EASILY SPLIT

The present invention relates to a process for drying wood at subatmospheric pressures or in vacuo.

An Italian patent specification discloses a process of this type whose principal characteristic consists in the fact that it comprises the operation of heating the wood until it is dry, using flat thermostatic elements, or a hot fluid does not impart moisture to the wood.

This process is an advance on previous technology, and the results obtained in the practical working of the above-mentioned patent specification were sufficiently good but not completely satisfactory.

In fact, the process of the above patent specification had several disadvantages relating to the quality of the dried wood and to loading and unloading the wood.

With reference to the quality of the dried wood, it was never possible completely to remove internal tensions from the wood, and although these tensions mostly did not produce cracks in the ordinary species of wood, it was nevertheless not possible to avoid damaging delicate species of wood or species of wood which were easily split.

In each case, these internal tensions were in practice of a permanent type, that is to say, they remained for a long period of time. For that reason, the wood could not be used for all this period of time, considerably reducing the advantage of the speed with which wood is dried at subatmospheric pressures or in vacuo.

Considerable difficulties were found in the practical operation of the patent with the flat thermostatic elements (they can be considered to be heating plates). In fact, these heating plates had to be removed both for loading and for unloading the wood. The manual work required by the removal of the plates was about the same as that necessary for handling the wood itself. Various attempts were made to mechanize the manipulation of heating plates, but they gave results of little significance and the equipment used was found to be complicated and scarcely effective. In addition, the movement of the plates requires an extra pause in the operation of vacuum, causing a loss of efficiency of the vacuum itself.

In order to overcome the difficulties caused by the heating plates, an attempt was made to carry out the process using an alternative to the heating plates, which alternative is indicated in the above mentioned patent. The alternative consists in heating the wood until it is dry by means of a fluid which does not impart moisture to the wood; however, the results were disastrous in that the surface of the wood was rapidly dried whilst the interior of the wood substantly maintained its original moisture content.

This caused considerable damage to the wood, as would be apparent to those skilled in the art of wood drying when they examine such conditions of operation. In effect, it is not possible, following the teaching of the above mentioned patent, to obtain the desired humidification of the heating fluid by means of the water vapour, coming from the wood.

The present invention, with a view to avoid the drawbacks noted above, provides a different process for drying large pieces of wood at subatmospheric pressures or in vacuo, in which the wood is placed in a sealed environment and is subjected to a positive drying phase carried out at subatmospheric pressures or in vacuo, after a preparatory phase in which the wood is heated-up, characterised in the fact that this heating-up phase comprises, in combination, the operations of:

I. introducing into said closed environment an operative fluid which imparts, or is capable of imparting, moisture to the wood, causing this fluid to cycle repeatedly around a closed circuit in such a way that in every cycle the fluid passes through a pile formed by the pieces of wood, and then returns without passing through the pile; and II. supplying thermal energy, and possibly water or water vapour, to the operative fluid in such a way that the thermal content (which may be referred to as enthalpy) of the fluid increases overall in each cycle at a diminishing rate until the fluid reaches a substantially steady cyclical state in which there is no overall increase in its thermal content in each subsequent cycle, the thermal content varying between a minimum value after having passed through the pile of wood and a maximum value after having completed its return, while at the same time the absolute water content of the fluid remains substantially the same, both when passing through the pile of wood and when returning.

Further characteristics and advantages of the invention will be apparent from the following detailed description, in which an embodiment of the invention is particularly described, by way of example, with reference to the accompanying drawings, of which:

Figure 2:
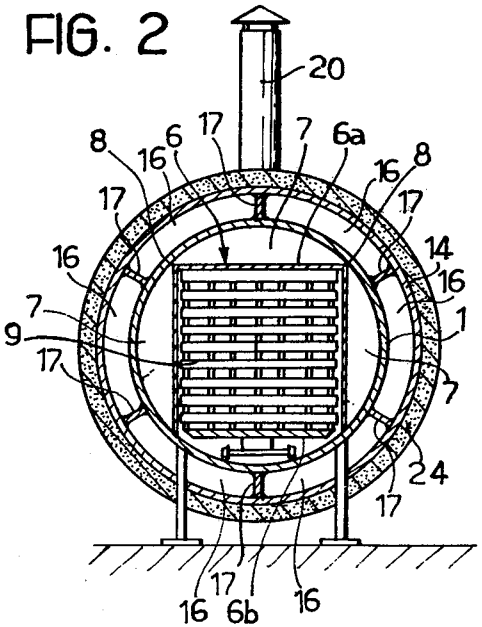
FIG. 2 is a transverse section through the drying apparatus.
Figure 1:
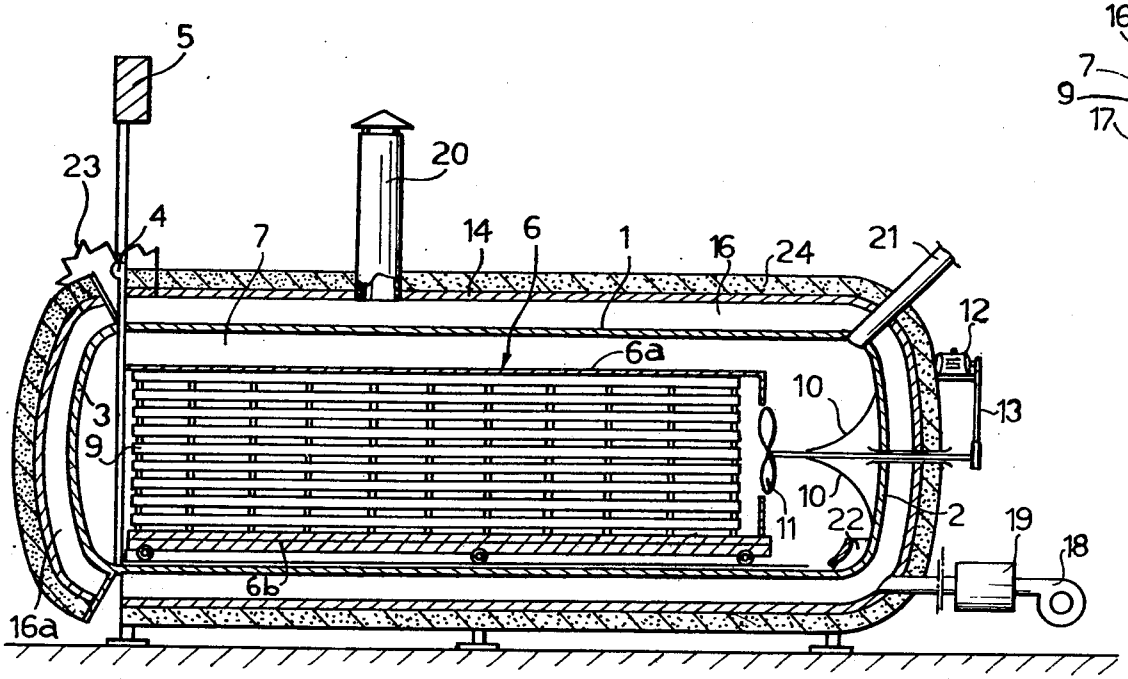
FIG. 1 is a longitudinal section through a drying apparatus for carrying out the process according to the invention.

With reference to FIGS. 1 and 2, 1 indicates a horizontal axis, cylindrical chamber made of steel plate, suitable for resisting external pressures. One end of the chamber 1 is closed by a fixed end wall 2, while the opposite end is closed by an end wall 3 which is movable, being hinged about a horizontal axis 4 and provided with a counterweight 5.

A container 6 for the wood is positioned inside the chamber 1, the walls *6a* and *6b* of the container 6 forming cavities or ducts 7 with the walls of the chamber 1.

Preferably, as illustrated in FIGS. 1 and 2, the container 6 is in the form of a square cross-section tunnel, of which three interconnected walls *6a* forming the exterior of the tunnel, are fixed to the walls of the chamber 1 at 8, whilst the fourth wall *6b* closes the bottom of the other three walls *6a* and forms a floor for supporting a pile of wood 9.

The ends of the tunnel-shaped container 6 are open and face the two end walls 2 and 3 of the container 1, the end wall 3 being shaped to act like a deflector while the other end wall 2 is provided with a deflector 10.

A helicoidal fan 11 is arranged at that end of the tunnel-shaped container 6 which is nearer the end wall 2, the shaft of the fan 11 passing through the end wall 2 to the outside, and being driven by an electric motor 12 by means of a belt transmission 13.

The horizontal wall *6b* of the container 6 is provided with wheels by means of which it can be withdrawn from the chamber 1 when the movable end wall 3 is open, for loading and unloading the wood.

The walls 6a of the tunnel-shaped container 6 can be made of flexible material or pliable material which acts like a bellows, in order to confine the pile of wood 9.

A cover 14 is arranged outside the chamber 1, and the walls of the cover 14 form, with the walls of the chamber 1, cavities or ducts which surround the chamber 1. The cover 14 has an independent portion which extends over the movable end wall 3, and the resulting cavity or duct 16a is connected with the other ducts 16 by means of flexible conduits 23, which are shown schematically.

The ducts 16 are divided by radial walls 17 which extend parallel to the axis of the chamber 1.

The radial walls 17 have one end interrupted to form a continuous passage for hot products of combustion produced by a burner 18 connected to the ducts 16 by way of a combustion chamber 19.

These products of combustion are exhausted into the atmosphere through a stack 20. The flow of the products of combustion occurs in such a way that they surround the chamber 1.

The chamber 1 is put into communication with a high capacity suction or vacuum pump (not shown in the drawings) by way of a conduit 21.

In its interior, the chamber 1 is provided with a pocket 22 for containing water supplied from the exterior of the chamber 1. The pocket 22 is in closed contact with the wall of the chamber 1, making a substantial extension of its own lateral surface. In particular, as is shown in FIG. 1, one of the walls of the pocket 22 is constituted by a part of the chamber 1 which is situated at the point where the products of combustion are hottest.

The cover 14 is clad with a cover of thermally insulating material 24.

Instead of hot products of combustion, the heating fluid or heating means in the ducts 16 can be hot water or any other heating means.

The drying process takes place in the following manner: after having inserted the pile of wood 9 into the interior of the container 6, the chamber 1 is sealed hermetically not only closing the movable end wall 3 but also every other communication with the exterior. In this way, the chamber 1 remains full of air at atmospheric pressure and at the ambient temperature.

In this case, this air constitutes the operative fluid for heating the wood. If one wants to use an operative fluid other than air, the suction or vacuum pump is first of all used in order to exhaust the air from the chamber 1; immediately afterwards, keeping the suction or vacuum pump stopped, the operative fluid is supplied to the chamber 1, the operative fluid being a fluid which imparts, or is capable of imparting, moisture to the wood.

At this point, the burner 18 is turned on and the fan 11 is started.

The hot products of combustion pass over the external surface of the walls of the chamber 1, heating them.

At the same time, the fan 11 causes the operative fluid to cycle repeatedly around a closed circuit.

In each cycle, the fluid makes an output passage through the interior of the tunnel-shaped container 6, in this way passing through the pile of wood 9, and a return passage, passing through the ducts 7 and in this way, along the hot walls of the chamber 1. In this manner, thermal energy is transferred to the operative fluid from the exterior of the chamber 1.

Simultaneously, the water contained in the pocket 22 evaporates, increasing the absolute humidity of the wood.

Figure 3:
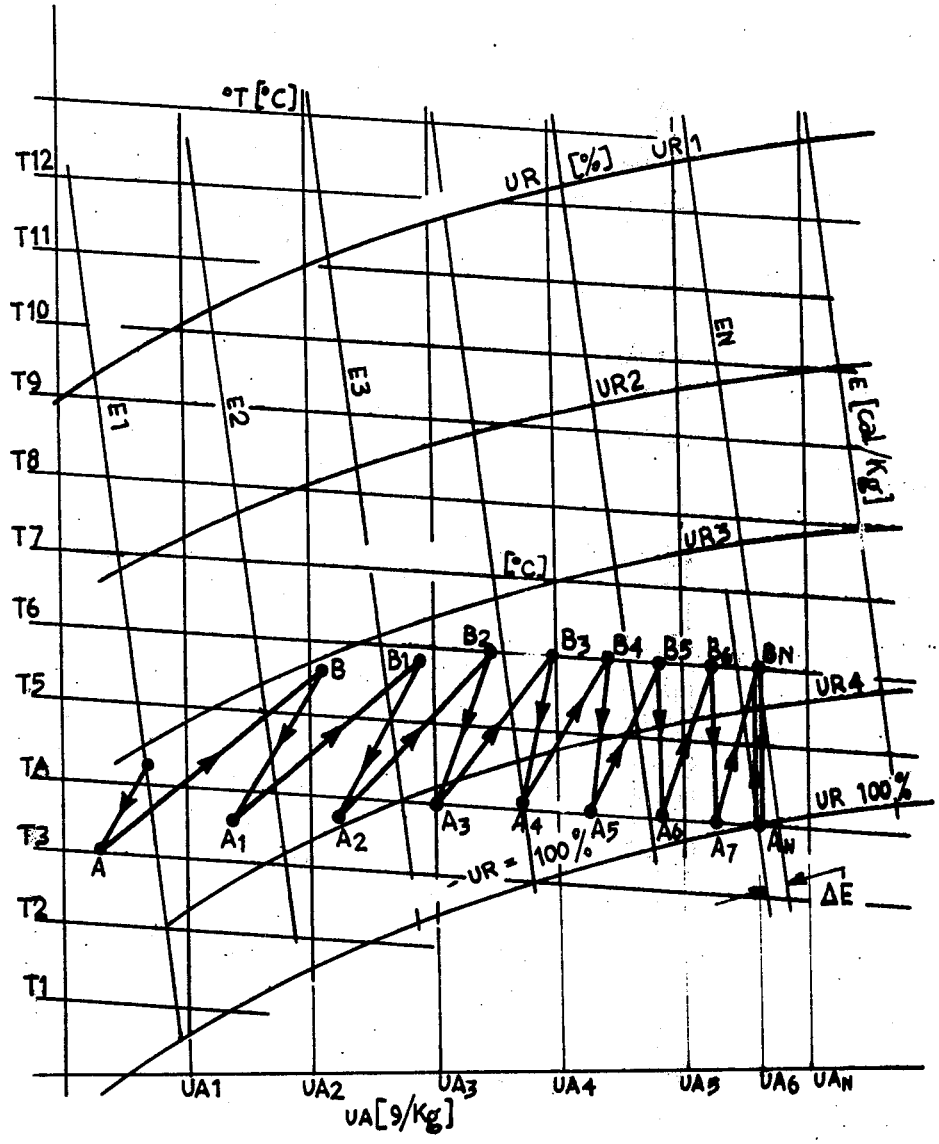
FIG. 3 is a Mollier air humidity diagram for the phase in which the operative fluid is heated up.

FIG. 3 indicates the properties of the operative fluid during the phase in which the wood is heated up.

In FIG. 3 lines T1, T2 . . . TN represent the temperature of the air in degrees centigrade, the temperature increasing from T1 to TN.

Lines UR1, UR2, UR3 . . . UR100% represent the relative humidity of the air, the humidity increasing from UR1 to UR100%, the line UR100% representing the saturation line; the lines UA1, UA2 . . . UAN represent the absolute humidity of the air in grams/kg, the humidity increasing from UA1 to UAN; and the lines E1, E2 . . . EN represent the thermal content or enthalpy of the air in Cal/kg, increasing from E1 to EN.

Starting from point A, which represents the properties of the air at the beginning of the return passage of the cycle, through the ducts 6, one reaches the point B which represents the properties of the air at the end of this return passage, i.e. at the beginning of the following output passage through the pile of wood 9; during this return passage, from A to B, the air heats up, absorbing heat from the walls of the chamber 1, and at the same time becomes more humid.

The same occurs in all the return passages A1 to B1, A2 to B2, A3 to B3, etc.

In the output passage, from B to A1 (through the pile of wood 9), the air cools down and its humidity drops, heat and moisture being passed to the wood.

The same occurs in all the output passages B1 to A2, B2 to A3, B3 to A4 etc.

However, in each cycle A B A1, A1 B1 A2, A2 B2 A3, etc. the overall thermal content of the fluid increases; noretheless, this increase occurs at a diminishing rate as this phase of the operation continues, until one reaches a substantially steady cyclical state AN BN AN in which the overall thermal content remains substantially the same, varying between a minimum value at the end of the return passage and a maximum value at the end of the outward passage.

During this interim period, that is to say, before reaching the steady state, the absolute humidity of the operative fluid decreases while the fluid makes its outward passage through the pile of wood 9; this decrease in absolute humidity diminishes as the operation proceeds and as the operative fluid approaches its steady state in which the decrease no longer occurs.

When the steady cyclical state has been reached one continues to supply water to the pocket 22 or causes the pocket 22 to become empty, in such a way that the circulating air attains a constant absolute humidity, that is to say without the air absorbing moisture from, or imparting moisture to, the wood.

In each case, the supply of heat and moisture to the air is regulated in accordance with the actual temperature of the wood and also in accordance with the velocity of the air through the pile of wood 9 in such a way that the increase in temperature and increase in absolute humidity between the entrance to and exit from the pile of wood 9 are both very small.

In particular, after reaching the steady cyclical state, this increase in temperature should be maintained below 3° C.

However, in no case, should the temperature of the walls of the chamber 1 drop below the temperature of the surface of wood, in order to avoid condensation of water on the walls of the chamber 1 and thereby a decrease in the humidity of the air.

After reaching the steady cyclical state, the heating-up phase is continued until the wood has been heated throughout its thickness, supplying to the wood however a quantity of heat which is greater than that necessary to evaporate the water supplied to the wood during the interim period, that is to say, before reaching the steady cyclical state. This interim period has a restricted duration compared with the duration of the whole heating-up phase, the duration being less than 10% of the whole heating-up phase.

During the interim period, the average relative humidity of the operative fluid increases with every cycle, approaching a maximum which is nearly 100%, at which point the operative fluid reaches the steady cyclical state.

It will be seen that the air is initially at ambient temperature and pressure, so that when the chamber 1 has been sealed hermetically at the beginning of the heating-up phase, the thermal expansion of the air causes its pressure to rise, suppressing the evaporation of water from the wood.

The heating-up phase is terminated when the whole thickness of the wood has been heated up, as already stated above.

When the heating-up phase is finished, the burner 18 and the fan 10 are de-energized, while the suction or vacuum pump is activated; the following reduction in pressure causes the moisture contained in the wood to evaporate while the wood cools down until it reaches its dew point. When the dew point has been reached, there would be no purpose in continuing the reduction in pressure, and the suction or vacuum pump is stopped and atmospheric air is introduced into the chamber 1, in order to initiate a new heating-up phase.

Heating-up phases and pressure reduction phases follow one another alternatively, until the wood has reached the desired dryness or moisture content.

In accordance with the process of the invention, all unequalities in the humidity content of the wood are practically eliminated for the whole duration of the drying process, so that the dried wood has no cracks or abnormal deformation, and also no internal tensions.

The wood can be loaded and unloaded using forklift trucks in the usual manner, when the wall or floor **6*b* has been drawn out of the chamber 1**.

What is claimed is:

1. A process of drying large pieces of wood comprising a step of heating a drying gas and a pile of said pieces of wood in a sealed container to accumulate heat in the wood under inherently increasing pressure of said gas, followed by a step of connecting the container to a vacuum source to produce evaporation of moisture from the wood by the heat accumulated in the latter, wherein the heating step comprises:

circulating within said sealed container the said gas in humid condition in a closed circuit such that at every turn the gas is compelled to pass through the pile and then return along a distinct path which does not pass through the pile and is in heat-exchange relation with the walls of the container, heating the container as a whole from the outside to heat said gas on its return path by inflow of heat from the walls of the container to the gas, whereby the thermal content of the gas increases at each subsequent turn by a diminishing amount until the gas reaches a substantially steady state at which there is no overall increase of its thermal content at each subsequent turn while at the same time the absolute humidity of the gas remains substantially constant, both on passage through the pile and on return, and continuing the circulating and heating of the humid gas under said steady state conditions until the temperature drop of the gas between its entrance to and exit from the pile is less than 3° C.

2. The process of claim 1 further comprising additionally humidifying the circulating gas on its return path to produce a decrease in absolute humidity content of the gas on each passage of the latter through the pile until the said steady state is reached.

3. The process of claim 2, wherein the additional humidificating of the circulating gas is conducted to bring the absolute humidity content of the gas substantially to 100% of said steady state conditions.

4. The process of claim 2, wherein the additional humidificating is effected by providing in the container a pool of water in contact with a wall portion of the container and by allowing the water from the pool to evaporate into the gas as the latter circulates.

5. The process of claim 1, wherein the said gas in the container is provided by sealingly enclosing in the latter, together with the pile, atmospheric air, whereby superatmospheric pressure is inherently produced in the container during the heating.

6. In an apparatus for drying a pile of large pieces of wood comprising a closed container for the pile, heating means for heating the atmosphere in the container to indirectly heat the pile to accumulate heat in the latter and a connecting means extending from the container switchable from a condition wherein the container is sealed during heating to a condition wherein vacuum is applied to the container through said connecting means for drawing from the container the moisture vaporized from the wood by the heat accumulated in the latter, the improvement comprising:

the said heating means is arranged outside of the container and substantially completely envelopes the latter, whereby the said atmosphere is heated by the walls of the container to prevent condensation of moisture on the walls;

internal partitions in the container defining an open-ended tunnel for receiving the said pile;

and impeller means in the container adjacent one end of the tunnel to induce circulation of the said atmosphere in the container in a closed path a portion of which is defined by the said tunnel with the remaining portion being outside the tunnel in heat-exchange contact with the walls of the container.

7. In an apparatus as set forth in claim 6 further comprising a pocket in the container capable of containing a pool of water.

8. In an apparatus as set forth in claim 7, wherein a wall of said pocket is constituted by a wall portion of the container.

9. In an apparatus as set forth in claim 6, wherein one of the said partitions is removable from the container and provides a supporting surface for the pile.

10. In an apparatus as set forth in claim 6, wherein the said partitions are of a pliable material adaptable to the contour of the pile.

11. In an apparatus as set forth in claim 6, wherein the heating jacket is externally confined by a heat-insulated shell, and further comprising a fuel burner arranged to deliver its hot combustion gases into the jacket to heat the container.

* * * * *